US006903638B2

(12) United States Patent
Nakamura et al.

(10) Patent No.: US 6,903,638 B2
(45) Date of Patent: Jun. 7, 2005

(54) COMPLEX ELECTROMAGNETIC RELAY

(75) Inventors: Akihiko Nakamura, Shinagawa (JP); Shigemitsu Aoki, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/936,581

(22) Filed: Sep. 9, 2004

(65) Prior Publication Data

US 2005/0057332 A1 Mar. 17, 2005

(30) Foreign Application Priority Data

Sep. 12, 2003 (JP) ..... 2003-321496

(51) Int. Cl.[7] ..... H01H 67/00; H01H 51/22; H01H 13/02

(52) U.S. Cl. ..... 335/78; 335/119; 335/159; 335/162; 335/202

(58) Field of Search ..... 335/78–86, 106, 335/107, 119, 159–163, 202

(56) References Cited

U.S. PATENT DOCUMENTS 4,959,627 A * 9/1990 Iizumi et al. ..... 335/106
5,929,730 A * 7/1999 Hendel ..... 335/78
6,225,880 B1 * 5/2001 Kern ..... 335/78
6,337,614 B1 * 1/2002 Tsutsui ..... 335/160
6,414,576 B1 * 7/2002 Nakamura et al. ..... 335/83
6,621,394 B2 * 9/2003 Ono et al. ..... 335/159
6,771,154 B1 * 8/2004 Funayama et al. ..... 335/159

FOREIGN PATENT DOCUMENTS

JP 2000-123699 4/2000
JP 2003-59383 2/2003

* cited by examiner

*Primary Examiner*—Ramon M. Barrera
(74) *Attorney, Agent, or Firm*—Staas & Halsey LLP

(57) ABSTRACT

A complex electromagnetic relay including a plurality of relay structures configured respectively as relays independent of each other, each relay structure including an electromagnet assembly and a contact section acting to open or close in accordance with an operation of the electromagnet assembly; and a housing accommodating the relay structures in a mutually inverted orientation with contact sections of the relay structures being located alternately at opposing sides. The electromagnet assemblies in the relay structures are provided individually with bobbins supporting coils. The housing includes an enclosing wall enclosing the relay structures in an envelope-like manner and a partition wall arranged between the relay structures disposed side-by-side to separate the relay structures from each other. The bobbins of the electromagnet assemblies are fixedly attached to the enclosing wall as well as to the partition wall.

3 Claims, 9 Drawing Sheets

COMPLEX ELECTROMAGNETIC RELAY

BACKGROUND OF THE INVENTION

1. Field of the Invention

The present invention relates generally to an electromagnetic relay and, more particularly, to a complex electromagnetic relay including a plurality of relay structures, accommodated in a common housing, which are configured respectively as electromagnetic relays functionally independent of each other.

2. Description of the Related Art

There is known a complex electromagnetic relay including a plurality of relay structures accommodated in a single common housing in a side-by-side arrangement, wherein the respective relay structures are configured as electromagnetic relays functionally independent of each other and wherein each relay structure includes an electromagnet assembly and a contact section acting to open or close in accordance with the operation of the electromagnet assembly. This type of complex electromagnetic relay can be used in a control circuit frequently switching the operation of a motor or a solenoid between normal and reverse directions. Also, due to the provision of the common housing, the complex electromagnetic relay exhibits an effect of reducing a relay mount space, in comparison with a configuration using a plurality of electromagnetic relays having respective housings independent of each other, and, therefore, is effectively applicable to a control circuit where circuit components must be mounted in a narrow space, e.g., a control circuit for a vehicle-mounted electric-powered appliance such as a power window. particularly, a complex electromagnetic relay, in which a plurality of relay structures are configured as electromagnetic relays mechanically independent of each other in a common housing, makes it possible to control plural electric-powered appliances individually and in a timely fashion by a single complex electromagnetic relay, in contrast to another type of complex electromagnetic relay in which a pair of relay structures share a certain part of contact sections thereof with each other by, e.g., sharing a terminal member having a stationary terminal (i.e., a stationary contact member).

Japanese Unexamined patent publication (Kokai) No. 2003-59383 (JP-A-2003-59383) discloses a complex electromagnetic relay, in which plural (or a pair of) relay structures independent of each other are accommodated in a single housing so as to be oriented reversely to each other with the contact sections thereof being located alternately at opposing sides. In such an arrangement that the plural relay structures are placed to be inverted relative to each other as described in JP-A-2003-59383, coil-terminal pairs provided in the respective relay structures are arranged so as to protrude from the housing at positions spaced away from each other and, therefore, it is possible to advantageously facilitate the formation of a circuit pattern in an electromagnetic-relay mount board.

In the complex electromagnetic relay disclosed in JP-A-2003-59383, a pair of relay structures, each of which is configured as an independent electromagnetic relay, are mounted in a mutually inverted orientation onto a base block acting as a common holding member, and a box-like cover is attached to the base block so as to form the housing accommodating the relay structures. In this arrangement, problems may arise due to the presence of the base block, in that the dimension of the complex electromagnetic relay is increased especially in a height direction, and that the numbers of parts and of assembling steps are increased. Further, in this arrangement, it may be difficult to reduce the dimension of a housing while ensuring a desired insulation distance or clearance between the relay structures disposed side-by-side or, in particular, between armatures as actuating elements, in the respective electromagnet assemblies.

SUMMARY OF THE INVENTION

It is an object of the present invention to provide a complex electromagnetic relay including a plurality of relay structures accommodated in a common housing, which are configured respectively as electromagnetic relays independent of each other, in a mutually inverted orientation with the contact sections thereof being located alternately at opposing sides, wherein it is possible to reduce the dimension in a height direction as well as the numbers of parts and assembling steps, and wherein it is possible to ensure a desired insulation distance between the relay structures disposed side-by-side.

To accomplish the above object, the present invention provides a complex electromagnetic relay comprising a plurality of relay structures configured respectively as relays independent of each other, each relay structure including an electromagnet assembly and a contact section acting to open or close in accordance with an operation of the electromagnet assembly; and a housing accommodating the relay structures in a mutually inverted orientation with contact sections of the relay structures being located alternately at opposing sides; wherein electromagnet assemblies in the plurality of relay structures are provided, individually, with bobbins supporting coils; wherein the housing includes an enclosing wall enclosing the plurality of relay structures in an envelope-like manner and a partition wall arranged between the relay structures disposed side-by-side to separate the relay structures from each other; and wherein the bobbins of the electromagnet assemblies are fixedly attached to the enclosing wall as well as to the partition wall.

In the above complex electromagnetic relay, the housing may define a plurality of receptacles between the enclosing wall and the partition wall; and the complex electromagnetic relay may further comprise locating elements provided respectively in the plurality of receptacles of the housing, for constraining the relay structures into an mutually inverted orientation in the receptacles.

In this arrangement, the locating elements may comprise protrusions protruding in the plurality of receptacles of the housing in a mutually opposing positional relationship.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
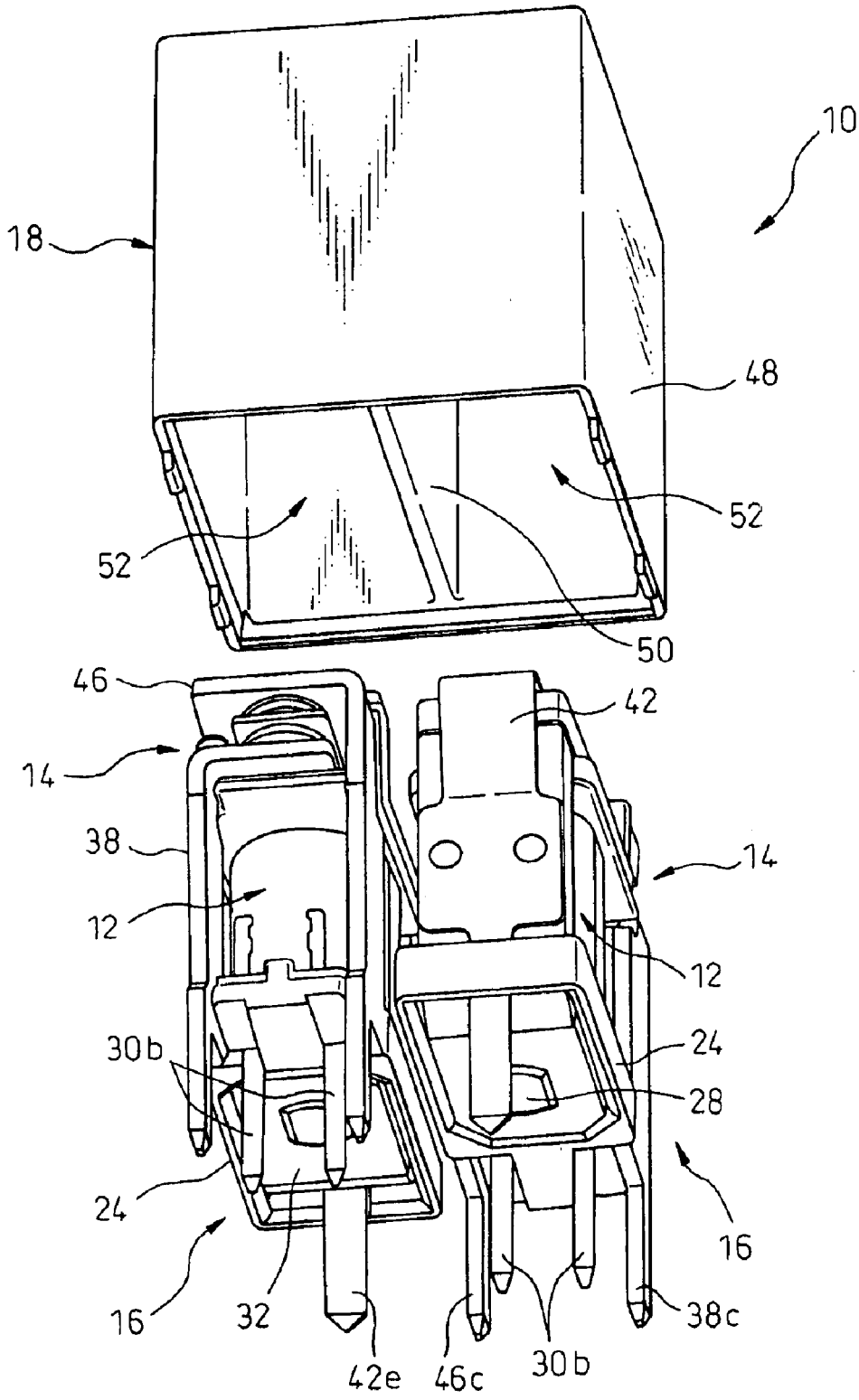
FIG. 1 is an exploded perspective view showing a complex electromagnetic relay according to an embodiment of the present invention, as viewed from a bottom side.

The embodiments of the present invention are described below in detail, with reference to the accompanying drawings. In the drawings, the same or similar components are denoted by common reference numerals.

Figure 2:
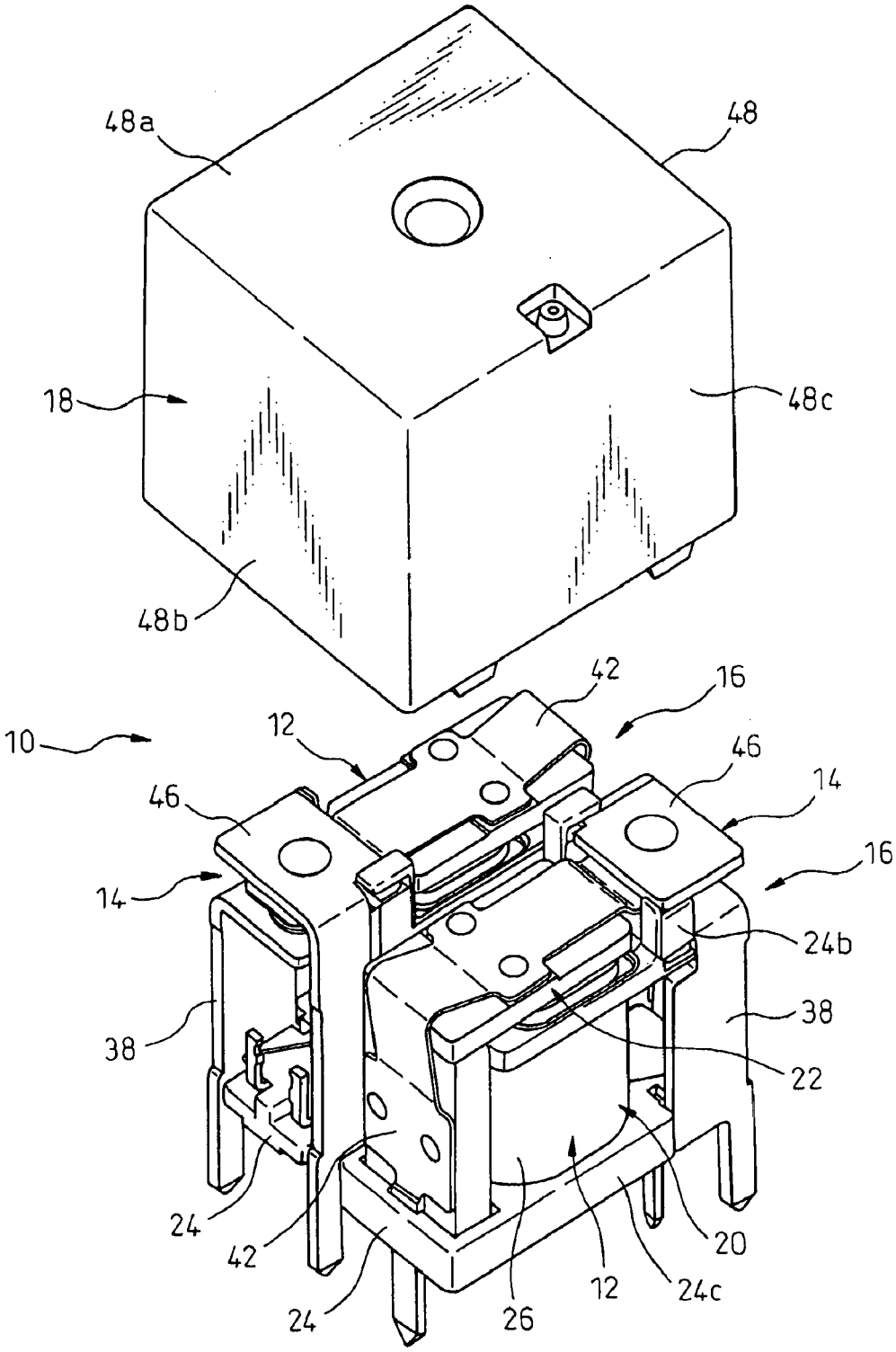
FIG. 2 is an exploded perspective view showing the electromagnetic relay of FIG. 1, as viewed from a top side.
Figure 3:
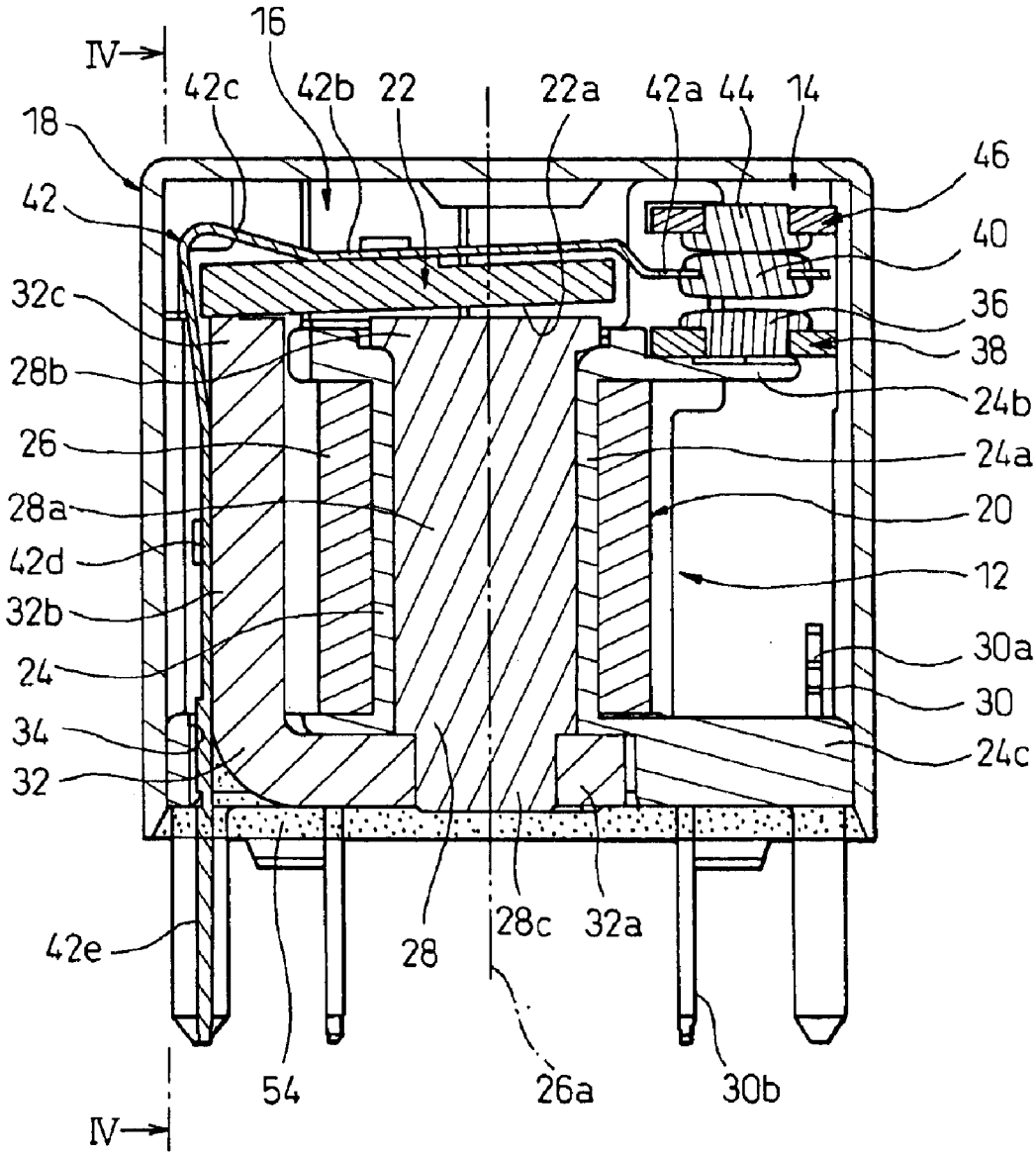
FIG. 3 is a sectional view, taken along a line III—III in FIG. 4, showing the electromagnetic relay of FIG. 1 in an assembled state.
Figure 4:
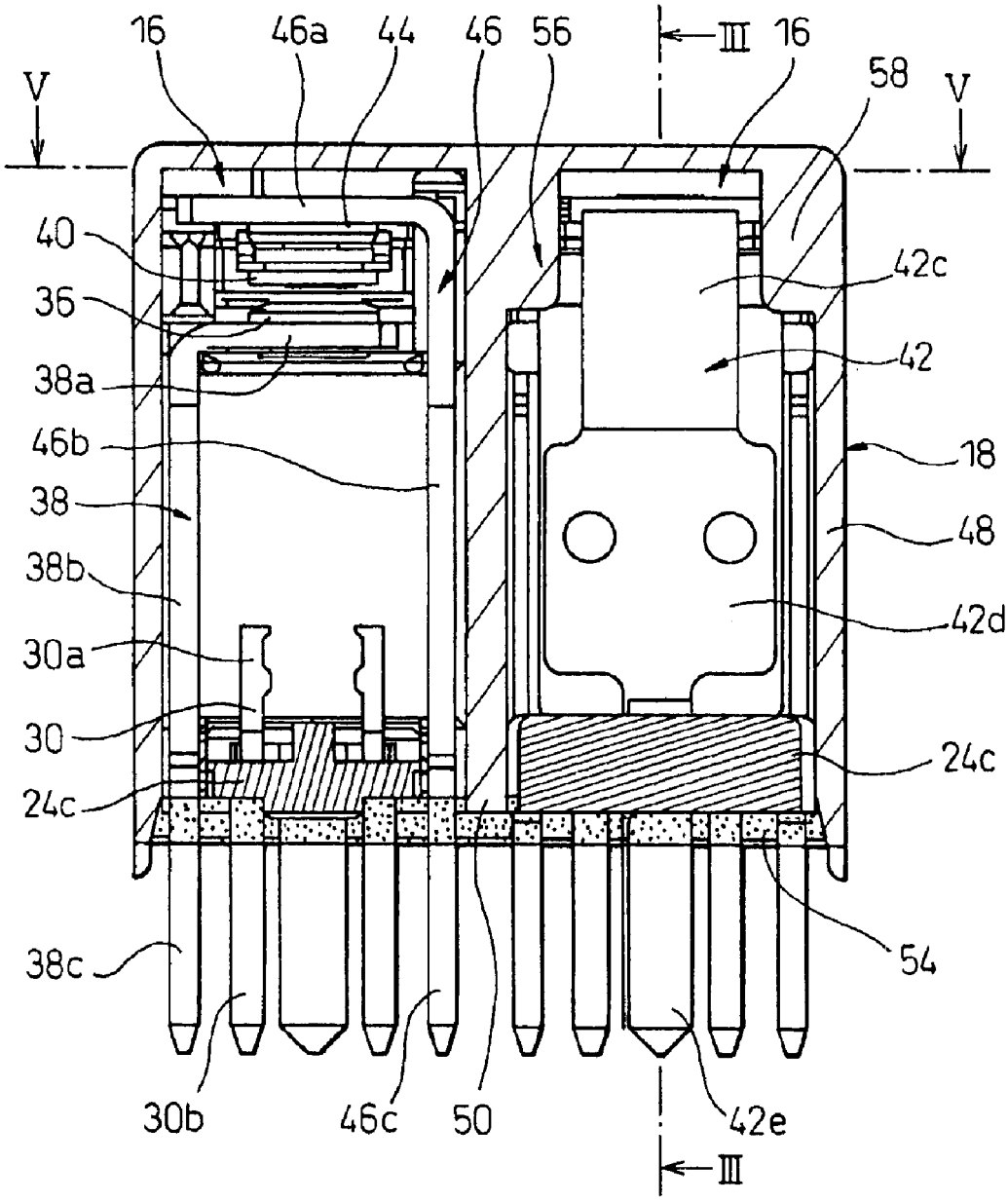
FIG. 4 is a sectional view showing the electromagnetic relay taken along a line IV—IV in FIG. 3.
Figure 5:
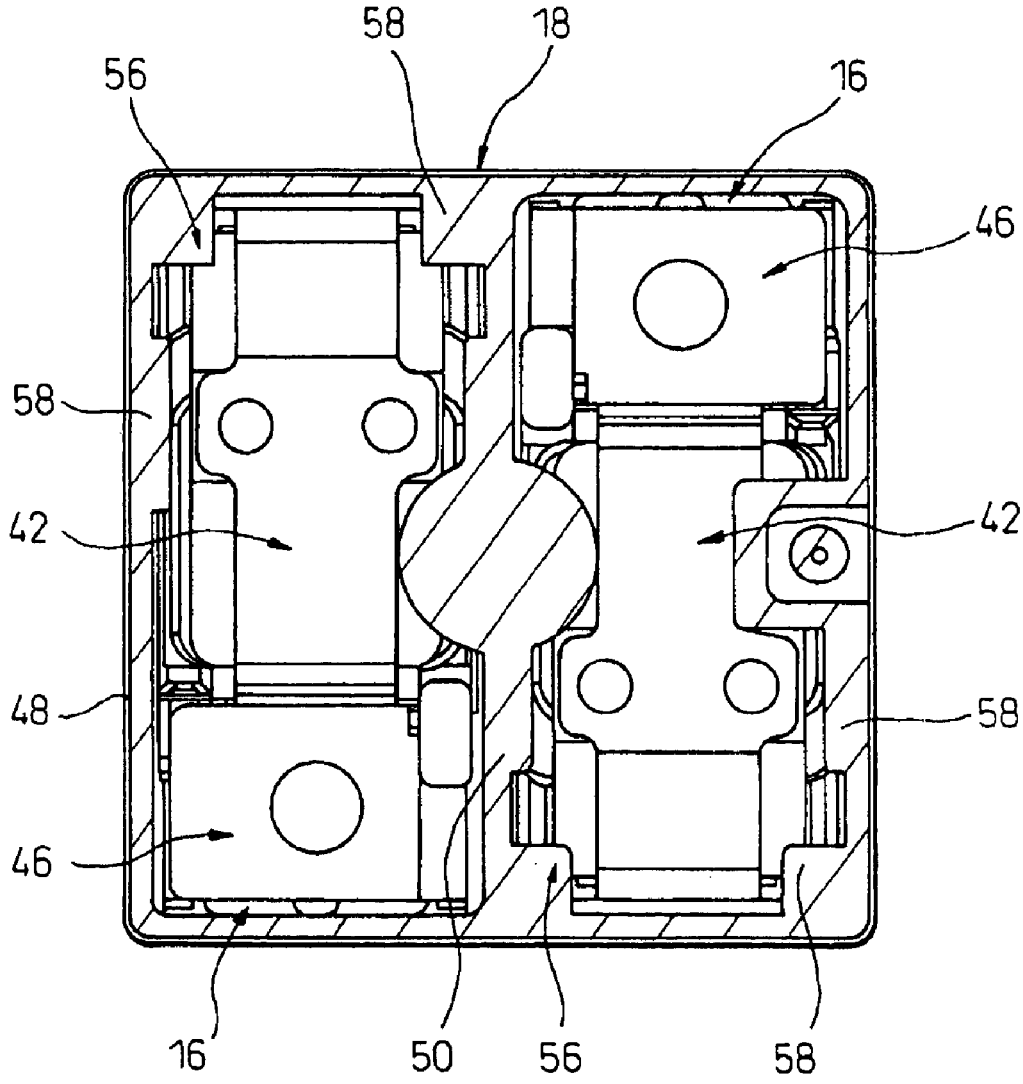
FIG. 5 is a sectional view showing the electromagnetic relay taken along a line V—V in FIG. 4.
Figure 6:
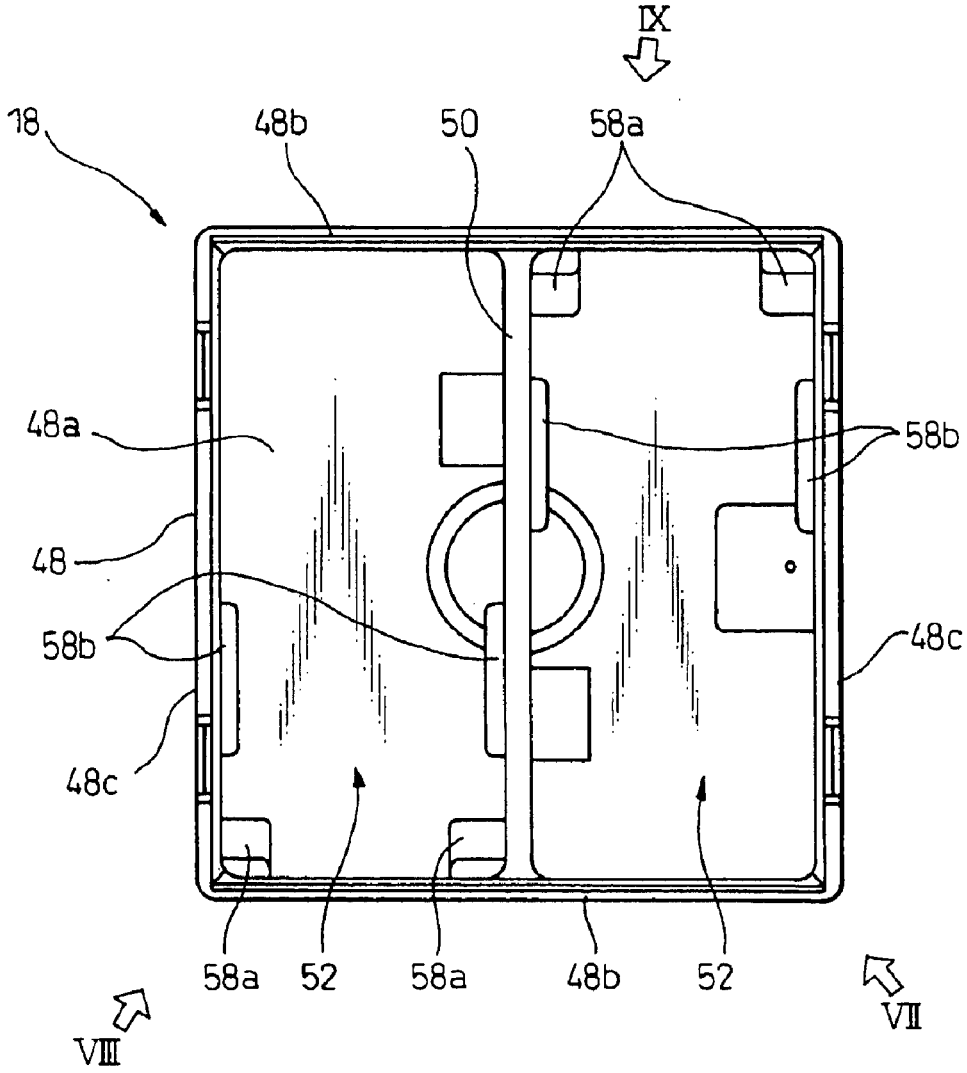
FIG. 6 is a plan view showing a housing provided in the electromagnetic relay of FIG. 1, as viewed from an opening side thereof.
Figure 7:
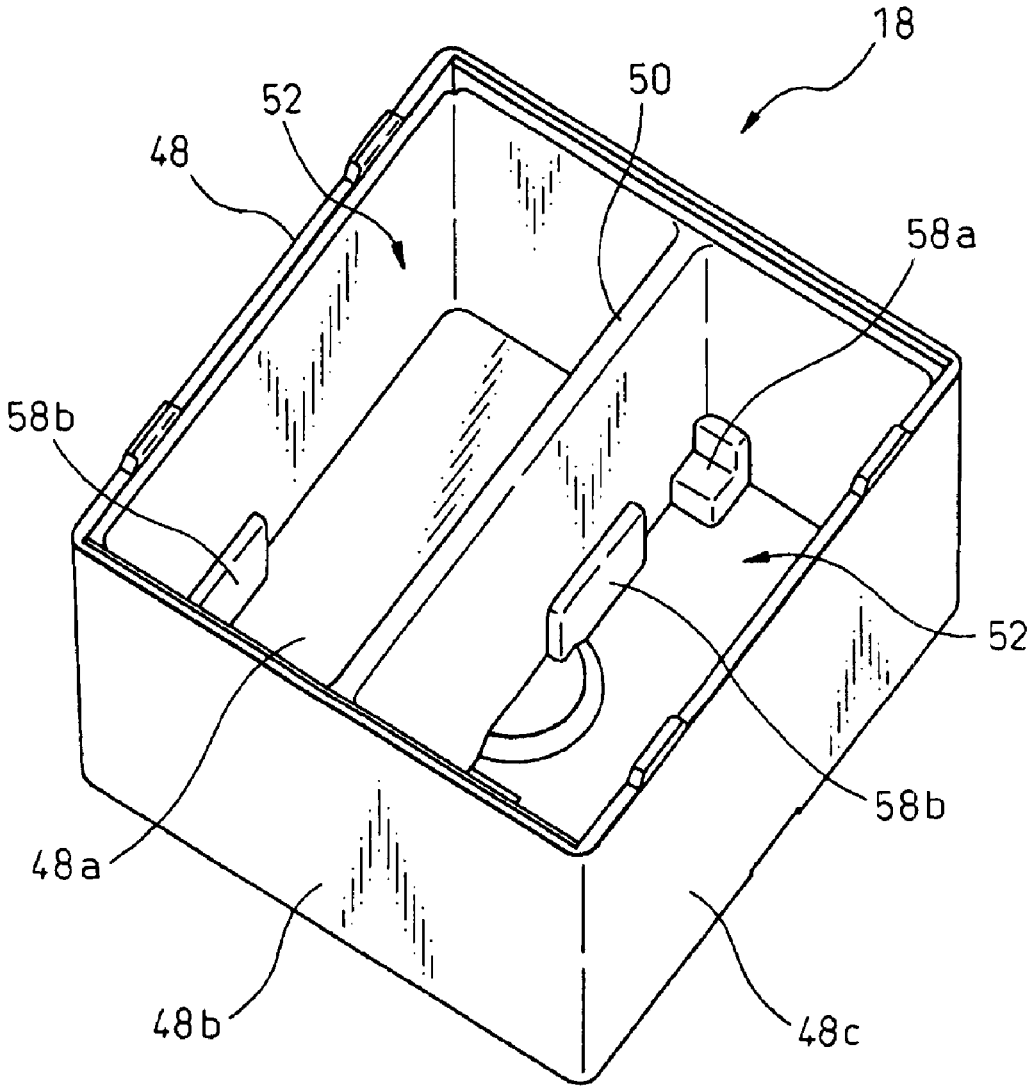
FIG. 7 is a perspective view showing the housing of FIG. 6, as viewed in a direction of an arrow VII.
Figure 8:
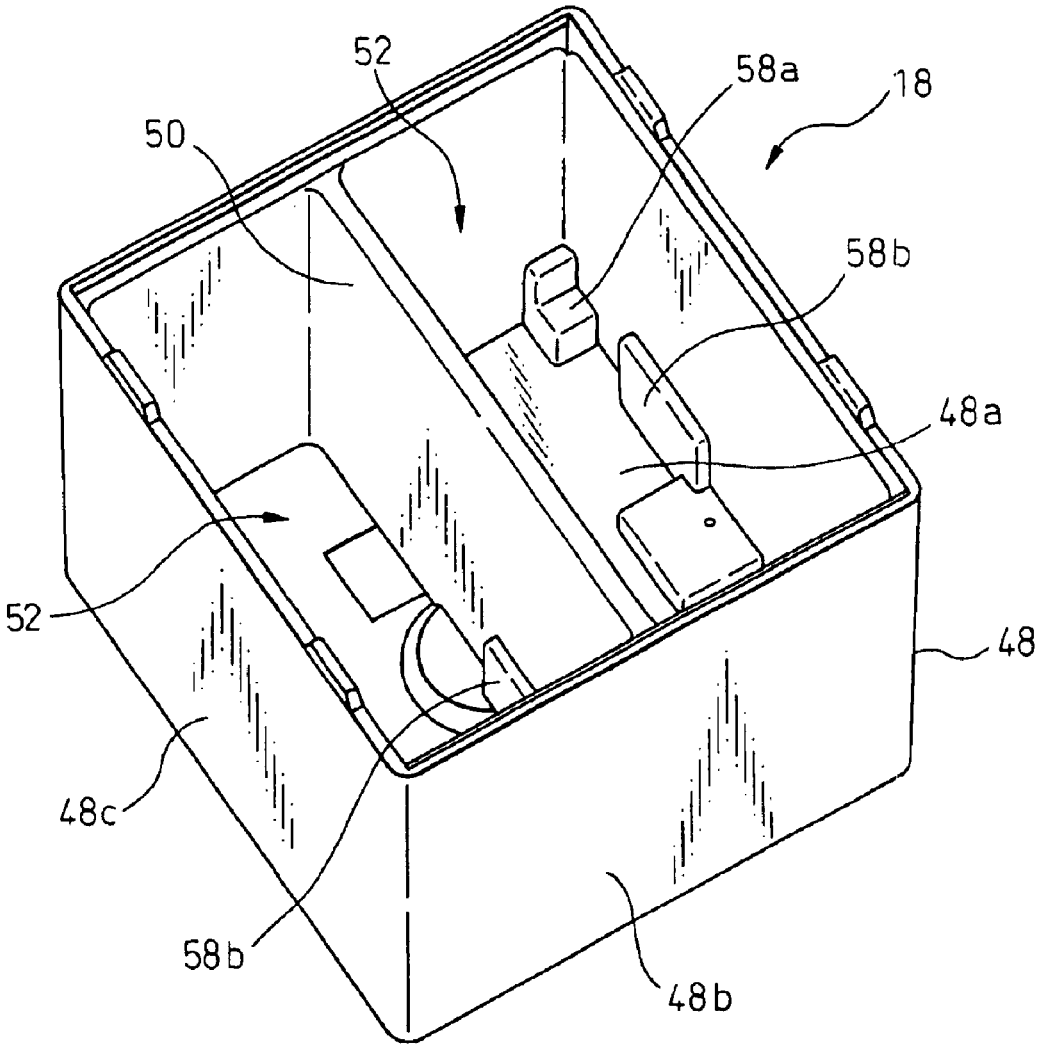
FIG. 8 is a perspective view showing the housing of FIG. 6, as viewed in a direction of an arrow VIII.
Figure 9:
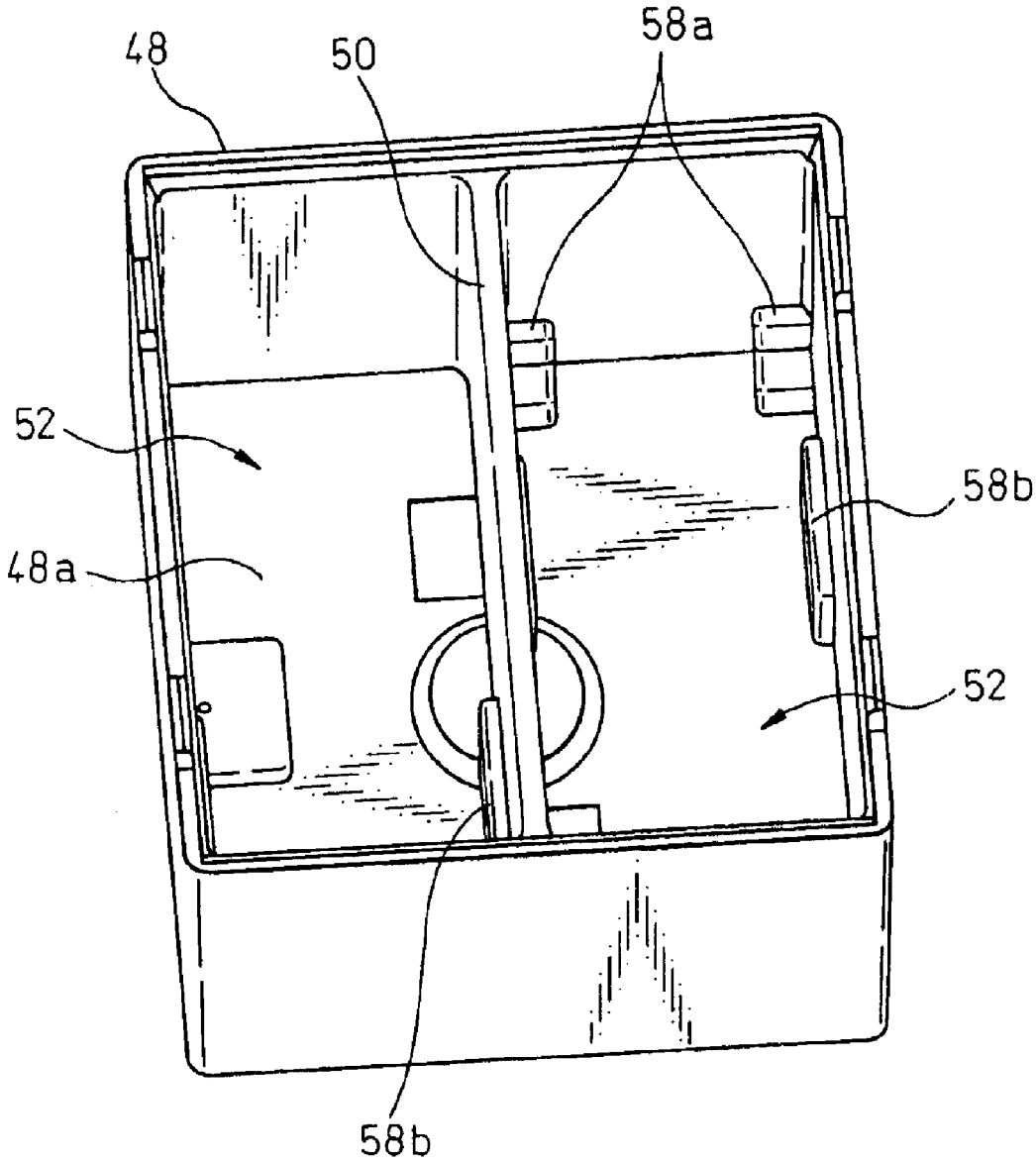
FIG. 9 is a perspective view showing the housing of FIG. 6, as viewed in a direction of an arrow IX.

Referring to the drawings, FIG. 1 is an exploded perspective view showing a complex electromagnetic relay 10, according to one embodiment of the present invention, as viewed from the bottom side thereof; FIG. 2 is an exploded perspective view showing the complex electromagnetic relay 10 as viewed from the top side thereof; and FIGS. 3 to 5 are sectional views of the complex electromagnetic relay 10. AS shown in FIGS. 1 and 2, the complex electromagnetic relay 10 includes a pair of relay structures 16 configured respectively as electromagnetic relays independent of each other, each relay structure including an electromagnet assembly 12 and a contact section 14 acting to open or close in accordance with the operation of the electromagnet assembly 12; and a housing 18 accommodating the relay structures 16 in a mutually inverted orientation with the contact sections 14 of the relay structures 16 being located alternately at opposing sides.

The electromagnet assembly 12 of each relay structure 16 includes an electromagnet 20 and an armature 22 driven by the electromagnet 20. As shown in FIG. 3, the electromagnet 20 includes a bobbin 24, a coil 26 wound and supported on the bobbin 24, and an iron core 28 attached to the bobbin 24 along a center axis 26*a* of the coil 26. The bobbin 24 is formed of an electrically insulating resinous molded article, and is provided with a hollow body 24*a* having a predetermined length for carrying the coil 26 and a pair of annular rectangular flanges 24*b*, 24*c* integrally joined to the opposite longitudinal ends of the body 24*a*.

The coil 26 is formed by tightly winding a required length of a conductive wire on the body 24*a* of the bobbin 24, and is securely held between the flanges 24*b*, 24*c* of the bobbin 24. The core 28 is a columnar member made of, e.g., a magnetic steel, and a generally cylindrical major part 28*a* thereof is securely received inside the body 24*a* of the bobbin 24 in an arrangement coaxial with the center axis 26*a* of the coil 26. The core 28 is provided integrally at one axial end thereof with a head 28*b* having a flat end face generally perpendicular to the coil center axis 26*a*, with the head 28*b* being exposed on the outside surface of the one (or upper, in the drawing) flange 24*b* of the bobbin 24.

In the other (or lower, in the drawing) flange 24*c* of the bobbin 24, a pair of coil terminals 30, made of a good electrically conductive material, is fixedly attached to one peripheral region of the flange 24*c*. The opposite ends of the conductive wire forming the coil 26 are joined respectively to the coil terminals 30. Each coil terminal 30 is integrally provided with an entwining portion 30*a* at one longitudinal end, to which the wire end of the coil 26 is entwined, and a terminal portion 30*b* at the other longitudinal end, and is fixed to the flange 24*c* so that the terminal portion 30*b* extends downward from the flange 24*c* at a side away from the coil 26.

The iron core 28 of the electromagnet 20 protrudes from the flange 24*c* of the bobbin 24, at a longitudinal end 28*c* at a side opposite to the head 28*b*, and a yoke 32 is fixedly connected to the core end 28*c* by, e.g., caulking, to form a magnetic path around the coil 26. The yoke 32 is an L-shaped plate-like rigid member made of, e.g., magnetic steel, wherein one flat plate part 32*a*thereof extends along the flange 24*c* of the bobbin 24 and the other flat plate part 32*b* thereof is laterally spaced from the coil 26 to extend substantially parallel to the coil center axis 26*a*. The flange 24*c* of the bobbin 24 is provided, in the other peripheral region apart from the coil terminal 30, with a through-hole 34 having a generally convex contour, and the flat plate part 32*b* of the yoke 32 is inserted into the through-hole 34. The flat plate part 32*b* of the yoke 32 extends so that the distal end 32*c* thereof reaches a position in close proximity to the head 28*b* of the iron core 28, and the armature 22 is supported on the yoke 32 to be adjacent to the distal end 32*c* in a rockable manner.

The armature 22 is a flat plate-like rigid member made of, e.g., a magnetic steel, and is resiliently supported on the yoke 32 of the electromagnet 20 in a relatively displaceable manner at a position oppositely facing the core head 28*b*, through a movable spring contact member provided in the contact section 14 as described later. The armature 22 cooperates with the iron core 28 and the yoke 32 of the electromagnet 20 to form a magnetic circuit by means of the coil 26. As described later, when the electromagnet 20 is not excited, the armature 22 is stationarily held in its returned or released position in which the major surface 22*a* thereof is spaced from the head 28*b* of the core 28 by a predetermined distance (FIG. 3). When the electromagnet 20 is excited, the armature 22 moves, due to the magnetic attractive force, in such a direction that the major surface 22*a* moves toward the core head 28*b*.

The contact section 14 of each relay structure 16 includes a first stationary contact member 38 having a make stationary contact 36, a movable contact spring member 42 having a movable contact 40, and a second stationary contact member 46 having a break stationary contact 44. The first stationary contact member 38 is formed by stamping an electrically conductive sheet-metal material into a predetermined shape and bending it into an L-shape, and includes a support plate portion 38*a* at one longitudinal end, for carrying the make stationary contact 36, a joint plate portion 38*b* at an intermediate length, extending generally perpendicular to the support plate portion 38*a*, and a terminal portion 38*c* at the other longitudinal end, extending like a pin from the joint plate portion 38*b* (FIG. 4). The make stationary contact 36 is made of a desired contact material, and is secured to the support plate portion 38*a* so as to protrude at a side away from the joint plate portion 38*b* by, e.g., caulking. The second stationary contact member 46 is formed by stamping an electrically conductive sheet-metal material into a predetermined shape and bending it into an L-shape, and includes a support plate portion 46*a* at one longitudinal end, for carrying the break stationary contact 44, a joint plate portion 46*b* at an intermediate length, extending generally perpendicular to the support plate portion 46*a*, and a terminal portion 46*c* at the other longitudinal end, extending like a pin from the joint plate portion 46*b* (FIG. 4). The break stationary contact 44 is made of a desired contact material and is secured to the support plate portion 46*a* so as to protrude at a side close to the joint plate portion 46*b* by, e.g., caulking.

The first and second stationary contact members 38, 46 are securely attached to the flanges 24*b*, 24*c* of the bobbin 24 of the electromagnet 20. In this connection, the joint plate portion 46*b* of the second stationary contact member 46 is longer than the joint plate portion 38*b* of the first stationary contact member 38 (FIG. 4). Therefore, in a condition where the stationary contact members 38, 46 are properly attached to the bobbin 24, the make stationary contact 36 and the break stationary contact 44 are disposed at mutually opposing positions, so as to be spaced from each other in a direction parallel to the coil center axis 26*a* of the electromagnet 20 (or in a vertical direction, in the drawing) and to fixedly maintain a certain space therebetween.

The movable contact spring member 42 is an electrically conductive thin plate member that is formed by stamping a thin plate made of, e.g., phosphor bronze, into a predetermined shape and bending it into an L-shape, and integrally includes a support plate portion 42*a* at one longitudinal end, for supporting the movable contact 40, a first attachment portion 42*b* extending from the support plate portion 42*a* in generally parallel thereto, an elastic hinge portion 42*c* at a longitudinal center, extending from the first attachment portion 42*b* to be bent in an L-shape, a second attachment portion 42*d* extending from the elastic hinge portion 42*c* in a direction generally perpendicular to the first attachment portion 42*b* at a side opposite to the first attachment portion 42*b*, and a terminal portion 42*e* at the other longitudinal end, extending like a pin from the second attachment portion 42*d* (FIG. 3). The movable contact spring member 42 is supported on the electromagnet assembly 12 in a state where the first attachment portion 42*b* is secured to the armature 22 by, e.g., caulking, and the second attachment portion 42*d* is secured to the yoke 32 by, e.g., caulking. In this state, the terminal portion 42*e* of the movable contact spring member 42 is inserted, together with the flat plate part 32*b* of the yoke 32, into the through-hole 34 formed in the flange 24*c* of the bobbin 24, and extends downward from the flange 24*c* in a direction away from the yoke 32.

The movable contact 40 is made of a desired contact material, and is secured to the support plate portion 42*a* so as to protrude at both sides of the support plate portion 42*a* by, e.g., caulking. In a condition where the movable contact spring member 42 is properly supported on the electromagnet assembly 12, the movable contact 40 is disposed between the make stationary contact 36 and the break stationary contact 44, so as to be displaceable in a direction generally parallel to the coil center axis 26*a* of the electromagnet 20, and is allowed to alternately contact with the stationary contacts 36, 44.

The elastic hinge portion 42*c* of the movable contact member 42 exerts a spring effect between the armature 22 and the yoke 32 so as to urge or bias the armature 22 in a direction away from the head 28*b* of the core 28. Therefore, when the electromagnet 20 is not excited, the armature 22 is stationarily held in its returned or released position in which the major surface 22*a* thereof is spaced away from the head 28*b* of the core 28 by a predetermined distance (FIG. 3), under the spring effect of the movable contact spring member 42, while one end (the left end in FIG. 3) of the armature 22 is disposed close to the yoke distal end 32*c*. In this state, the movable contact 40 of the movable contact spring member 42 comes into contact with the break stationary contact 44 of the second stationary contact member 46 under a pressing force. When the electromagnet 20 is excited, the armature 22 moves from the released position, due to the magnetic attractive force about one end thereof disposed close to the yoke distal end 32*c*, in a direction toward the core head 28*b* and against the spring force of the movable contact spring member 42. Then, the movable contact 40 of the movable contact spring member 42 comes into contact with the make stationary contact 36 of the first stationary contact member 38 under a pressing force, so as to close a make contact.

The complex electromagnetic relay 10 according to the present invention has a characteristic configuration wherein the housing 18 accommodating a pair of relay structures 16 in a mutually inverted orientation includes an enclosing wall 48 for enclosing the pair of relay structures 16 in an envelope-like manner, and a partition wall 50 arranged between the relay structures 16 disposed side-by-side to separate the relay structures 16 from each other. The enclosing wall 48 includes a flat plate-like top wall portion 48*a* having a generally rectangular shape in a plan view, and two pairs of opposing lateral wall portions 48*b*, 48*c*, each having a flat plate shape and extending integrally from the respective four edges of the top wall portion 48*a* to be perpendicular to the top wall portion 48*a*. The enclosing wall 48 opens at a side opposite to the top wall portion 48*a* along bottom edges of the opposing lateral walls 48*b*, 48*c*. The flat plate-like partition wall 50 is integrally and perpendicularly joined to the top wall portion 48*a* and one pair of opposing lateral wall portions 48*b* of the enclosing wall 48, and extends from the top wall portion 48*a* to the proximity of the bottom edges of the opposing lateral wall portions 48*b*, at a location dividing each of the top wall portion 48*a* and the pair of opposing lateral wall portions 48*b* in half. The housing 18 having the above configuration may be integrally formed from an electrically insulating material such as a synthetic resin.

The housing 18 defines a pair of receptacles 52, having generally rectangular cross-sectional shape substantially identical to each other, between the enclosing wall 48 and the partition wall 50. The pair of relay structures 16 are individually accommodated in the receptacles 52 in the mutually inverted orientation as described above. In a state where each relay structure 16 is properly accommodated in the corresponding receptacle 52 of the housing 18, the bobbin 24 of the electromagnet assembly 12 in the relay structure 16 is disposed in such a manner that the lower flange 24*c* supporting the coil terminals 30 is located adjacent to the bottom edges of the enclosing wall 48 and partition wall 50 so as to substantially close the opening of the housing 18. Also, in this state, the pair of coil terminals 30, the first and second stationary contact members 38, 46, and the movable contact spring member 42, which are provided in each relay structure 16, are placed so that the respective terminal portions 30*b*, 38*c*, 46*c* and 42*e* thereof protrude outside the housing 18. In this arrangement, an adhesive 54 is applied so as to cover the back surfaces (or exposed surfaces) of the bobbin flanges 24*c* of the relay structures 16 properly accommodated in the housing 18 (FIGS. 3 and 4). The adhesive 54 seals all clearances between the relay structures 16 and the housing 18, that may be otherwise exposed outside the housing 18, and fixedly attaches the bobbins 24 of the respective electromagnet assemblies 12 to the enclosing wall 48 as well as to the partition wall 50.

In the complex electromagnetic relay 10 configured as described above, a pair of relay structures 16, independent of each other, is disposed in a mutually inverted orientation with the contact sections 14 thereof being located alternately at opposing sides in the common housing 18, so that the pairs of the coil terminals 30 provided in the respective relay structures 16 are arranged in such a manner that the terminal portions 30*b* of the respective pairs protrude from the housing 18 at positions spaced from each other (FIG. 1).

Similarly, the first and second stationary contact members 38, 46 and the movable contact spring member 42, which are provided in the respective relay structures 16, are arranged in such a manner that the respective terminal portions 38*c*, 46*c* and 42*e* protrude from the housing 18 at positions spaced from each other. Therefore, an advantage is obtained in that a circuit pattern on a mount board (not shown) for the complex electromagnetic relay 10 can be easily formed. Moreover, the complex electromagnetic relay 10 is configured in such a manner that the relay structures 16 are fixedly supported on the housing 18 by the adhesive 54 for fixedly attaching the bobbins 24 of the respective electromagnet assemblies 12 to the enclosing wall 48 and the partition wall 50, so that, in comparison with the related-art configuration wherein a housing is constructed by attaching a box-like cover to a common base block on which a pair of relay structures is mounted, it is possible to eliminate the base block and, as a result, to reduce the height dimension of the complex electromagnetic relay 10 as well as the number of parts and the number of assembling steps. Furthermore, the complex electromagnetic relay 10 is configured in such a manner that the partition wall 50 of the housing 18 lies between the pair of relay structures 16 arranged side-by-side or, in particular, between the armatures 22 as actuating elements in the respective electromagnet assemblies 12, so that it is possible to readily ensure a desired insulation distance or clearance between the relay structures 16 arranged side-by-side.

In the complex electromagnetic relay 10 described above, it is advantageous that locating elements 56 are provided in the pair of receptacles 52 defined between the enclosing wall 48 and the partition wall 50 of the housing 18 (FIGS. 4 and 5), for constraining the respective relay structures 16 into the mutually inverted orientation in the receptacles 52. The locating elements 56 have a polarizing function for mechanically preventing each relay structure 16 from being accommodated in the receptacle 52 with the contact section 14 thereof being oriented reverse to a proper orientation when each relay structure 16 is attached to the housing 18. In the illustrated embodiment, the locating elements 56 include at least one pair of protrusions 58 protruding in the pair of receptacles 52 of the housing 18 in a mutually opposing positional relationship.

As shown in FIGS. 6 to 9, each receptacle 52 of the housing 18 is provided, adjacent to the top wall portion 48*a* of the enclosing wall 48 at respective joint regions (or corners) between one lateral wall portion 48*b* and the other lateral wall portion 48*c* as well as the partition wall 50, with a pair of L-shaped protrusions 58*a*, and, at mutually opposing positions on the lateral wall portion 48*c* and the partition wall 50, with a pair of flat plate-shaped protrusions 58*b*. The protrusions 58*a*, 58*b* have predetermined shapes and dimensions such that, when the relay structure 16 is inserted into each receptacle 52 in a proper orientation, the protrusions 58*a*, 58*b* do not obstruct certain components of the relay structure 16 but eliminate a useless space between the relay structure 16 and the enclosing wall 48 or the partition wall 50, and that, when the relay structure 16 is erroneously inserted into each receptacle 52 in an orientation reverse to the proper orientation, the protrusions 58*a*, 58*b* collide with certain components of the relay structure 16 so as to inhibit the complete insertion of the relay structure 16. Therefore, the protrusions 58*a*, 58*b* function not only to improve mechanical strength of the complex electromagnetic relay 10 in an assembled state against an external force, but also to eliminate unstableness of the relay structures 16 incorporated in the complex electromagnetic relay 10. The protrusions 58*a*, 58*b* may be formed integrally with the enclosing wall 48 and the partition wall 50 in a die for molding the housing 18, for example.

The complex electromagnetic relay according to the present invention may be used in, e.g., a control circuit frequently switching the operation of a motor or a solenoid between normal and reverse directions, and is particularly usable in an application wherein plural electric-powered appliances are individually and in a timely fashion controlled by a single complex electromagnetic relay. Also, the complex electromagnetic relay according to the present invention is effectively applicable to such a control circuit that circuit components should be mounted in a narrow space, such as a control circuit for a vehicle-mounted electric-powered appliance.

While the invention has been described with reference to specific preferred embodiments, it will be understood by those skilled in the art that various changes and modifications may be made thereto without departing from the spirit and scope of the appended claims. For example, the characteristic configuration of the complex electromagnetic relay according to the present invention may also be adopted in a complex electromagnetic relay including three or more relay structures arranged side-by-side and completely independent of each other.

What is claimed is:

1. A complex electromagnetic relay comprising:

a plurality of relay structures configured respectively as relays independent of each other, each relay structure including an electromagnet assembly and a contact section acting to open or close in accordance with an operation of said electromagnet assembly; and a housing accommodating said relay structures in a mutually inverted orientation with contact sections of said relay structures being located alternately at opposing sides;

wherein electromagnet assemblies in said plurality of relay structures are provided, individually, with bobbins supporting coils;

wherein said housing includes an enclosing wall enclosing said plurality of relay structures in an envelope-like manner and a partition wall arranged between said relay structures disposed side-by-side to separate said relay structures from each other; and wherein said bobbins of said electromagnet assemblies are fixedly attached to said enclosing wall as well as to said partition wall.

2. A complex electromagnetic relay as set forth in claim 1, wherein said housing defines a plurality of receptacles between said enclosing wall and said partition wall; and wherein said complex electromagnetic relay further comprises locating elements provided respectively in said plurality of receptacles of said housing, for constraining said relay structures into an mutually inverted orientation in said receptacles.

3. A complex electromagnetic relay as set forth in claim 2, wherein said locating elements comprise protrusions protruding in said plurality of receptacles of said housing in a mutually opposing positional relationship.

* * * * *